United States Patent [19]

Maki

[11] 4,432,193

[45] Feb. 21, 1984

[54] METHOD OF GRADING RADIATING TRANSMISSION LINES

[75] Inventor: Melvin C. Maki, Kanata, Canada

[73] Assignee: 501 Control Data Canada, Ltd., Ottawa, Canada

[21] Appl. No.: 420,069

[22] Filed: Sep. 20, 1982

[51] Int. Cl.[3] ..... H01Q 13/22; H01P 3/06

[52] U.S. Cl. ..... 57/3; 333/237

[58] Field of Search ..... 57/3, 6, 9, 13, 15, 57/31, 32, 215, 235, 259, 260; 333/237, 244; 343/771

[56] References Cited

U.S. PATENT DOCUMENTS

| | | | |
|---|---|---|---|
| 3,756,004 | 9/1973 | Gore | 57/3 X |
| 3,870,977 | 3/1975 | Peoples et al. . | |
| 3,949,329 | 4/1976 | Martin | 333/237 |
| 4,300,338 | 11/1981 | Harman et al. | 57/3 |
| 4,322,699 | 3/1982 | Hildebrand et al. | 343/771 X |
| 4,325,039 | 4/1982 | Allebone | 333/237 |
| 4,339,733 | 7/1982 | Smith | 333/237 |

FOREIGN PATENT DOCUMENTS 2031654 4/1980 United Kingdom .

*Primary Examiner*—Donald Watkins

*Attorney, Agent, or Firm*—Jones, Tullar & Cooper, P.C.

[57] ABSTRACT

A method of manufacturing leaky coaxial cable by winding conductive tapes around a core to provide apertures of a certain shape, number and density. By varying the width of one or both tapes the aperture distribution is varied thereby altering the coupling of the cable when used in a detection system. A graded cable showing such varying coupling can be used to compensate for cable attenuation losses and other variables.

10 Claims, 7 Drawing Figures

METHOD OF GRADING RADIATING TRANSMISSION LINES

This invention relates to the manufacture of leaky coaxial cables, also known as radiating cables, or radiating transmission lines, As is known, such cables are formed with discrete apertures in the outer conductive layer. A method of manufacturing such leaky coaxial cables is to provide a core having an inner conductor surrounded by a dielectric layer and to wind at least two conductive tapes around the core, the tape widths and pitch angles being selected to provide apertures of predetermined shape and surface area and of a predetermined number per defined length.

In some situations it is desirable to provide a change in the aperture dimensions and density along the length of a cable, which is termed "grading", to vary the leakage field. This can serve several purposes, e.g., to compensate for cable attenuation losses, for the geometry of the detection system installation, or for changes in the cable installation medium. U.S. Pat. No. 4,300,338 issued Nov. 17, 1981 in the names of R. K. Harman and M. Maki, and the corresponding Canadian Pat. No. 1,079,504, issued July 17, 1980 teach a method of varying the size and distribution of the apertures along the cable length and hence the coupling or leakage field by variation of tape pitch angles.

The present invention relates to an improved method of grading leaky coaxial cables to provide a coupling characteristic or leakage field that changes in a predetermined amount along the cable length.

Specifically, the invention relates to a method of manufacturing a leaky coaxial cable comprising the steps of providing a core having an inner conductor surrounded by a dielectric layer and winding at least two conductive tapes therearound. The tape widths and pitch angles at the beginning of the cable are selected to provide apertures having a predetermined shape, size and of a predetermined distribution along the cable length. Thereafter, the widths of the tapes are varied either continuously or in steps along the cable length to provide a predetermined change in the aperture size and density along the cable. Alternatively, both tape widths and pitch angles can be varied along the cable length to give the desired cable characteristics.

The word "tape" is intended to encompass conductors formed from woven filaments and flat assemblies of wires as well as solid conductors. The dielectric layer can be formed of any suitable insulating material, either solid or foam, or may be an airspace. The following definitions are used in this application:

- Braid: A fibrous or metallic group of filaments interwoven in cylindered form to form a covering over one or more wires.
- Serve: A filament or group of filaments such as fibers or wires, wound around a central core.
- Lay: The length measured along the axis of a wire or cable required for a single strand (in stranded wire) or conductor (in cable) to make one complete turn about the axis of the conductor or cable.

The invention will become apparent from the following description taken in conjunction with the accompanying drawings, in which.

DESCRIPTION OF THE PREFERRED EMBODIMENTS

Figure 1:
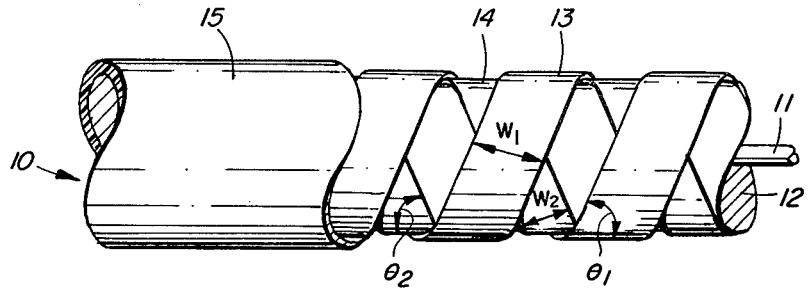
FIG. 1 is a diagrammatic view of the typical "beginning" of a leaky coaxial cable constructed by winding tapes of particular width at a particular pitch angle.
Figure 2:
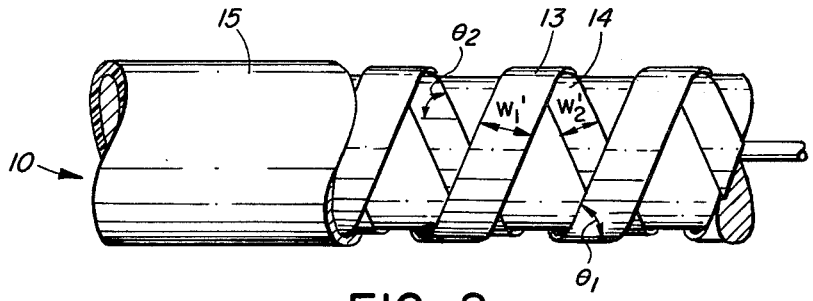
FIG. 2 is a diagrammatic view of the cable of FIG. 1 at a point further along the cable where the tape width has been changed.

FIG. 1 shows the type of leaky coaxial cable 10 with which the present invention is concerned. A single central conductor 11, either solid or stranded, is surrounded by a dielectric material 12 selected to provide a desired velocity of propagation within the cable. An outer conductive layer is formed by two conductive solid tapes 13 and 14. Although the tape is generally flat, some roughening or corrugation of the surface may be desirable to provide improved mechanical properties. The cable is covered by an outer non-conductive sheath 15. Tapes 13 and 14 are of widths $W_1$ and $W_2$, respectively, and helically wound at pitch angles $\theta_1$ and $\theta_2$. In FIG. 2, tape widths are varied to $W_1'$ and $W_2'$, respectively, and the same pitch angles maintained.

FIGS. 1 and 2 show an example of two sections along a cable that are graded by the procedure of this invention. In FIG. 1 the tape widths $W_1$ and $W_2$ are larger than those in FIG. 2, since two sections shown are consecutive along the cable length relative to the direction of signal flow. The width of the tape used in this embodiment is continuously tapered with length but can be stepwise tapered by splicing together pieces of different but constant width.

Figure 3:
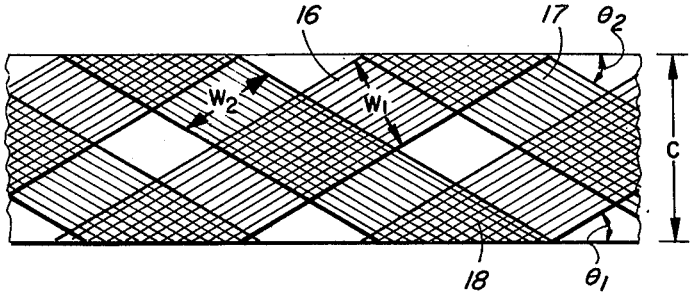
FIG. 3 is a representation of the "beginning" of a leaky coaxial cable formed with braided material. The cable is shown with its surface flattened: that is, c is its circumference.
Figure 4:
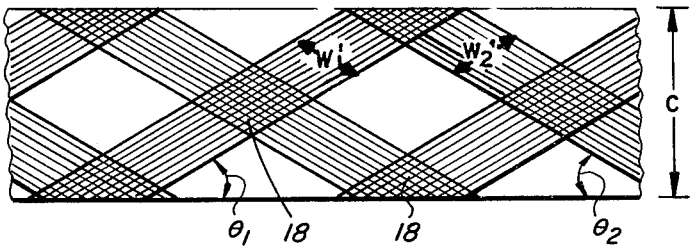
FIG. 4 is a view similar to FIG. 3 at a point further along the cable.

FIGS. 3 and 4 show an example where braided tapes are used to grade a cable by varying the tape width. In this case the taper of both tapes is obtained by periodically tying off the wires in adjacent carriers in the braiding process, equal numbers typically, though not necessarily, being tied off in each of the two lays. In the outer conductive layer the tapes 16 and 17 may be served or braided at the points of crossing 18.

Figure 6:
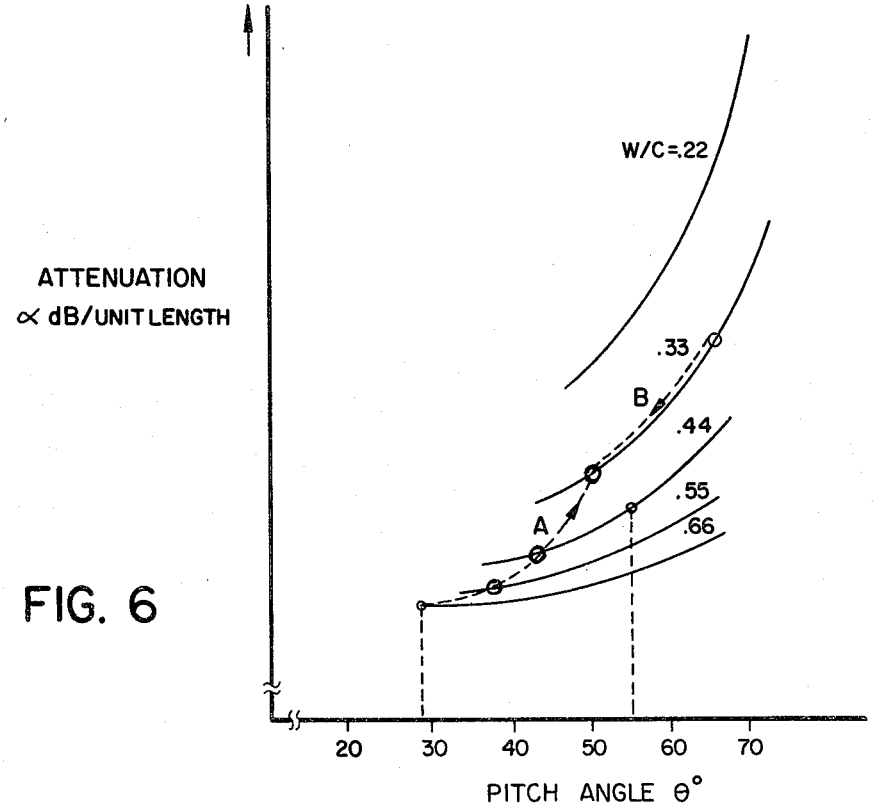
FIG. 6 shows the variation of attenuation as a function of tape width and pitch angle.
Figure 7:
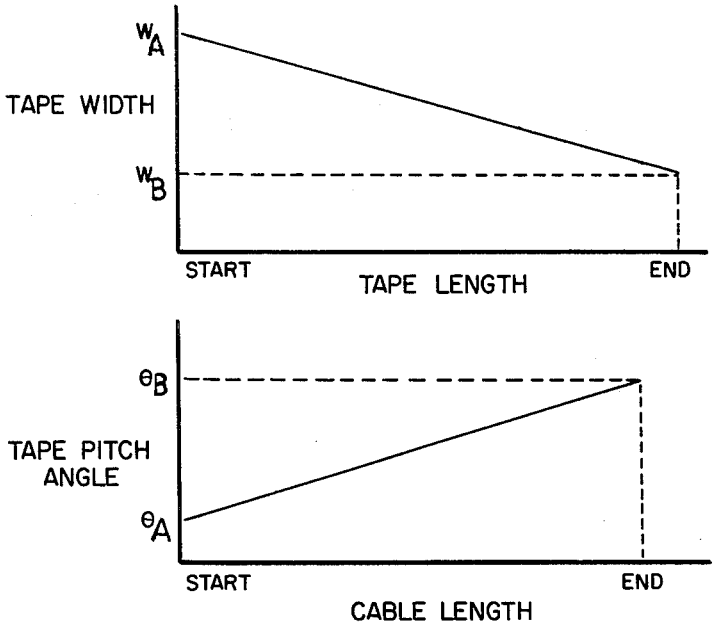
FIG. 7 shows a typical cable grading schedule for cable manufacturing.

It is possible to vary both tape widths and pitch angles or to vary the two pitches and widths separately, giving a total of four variables along the cable length. Generally, the required pitch and width functions must be obtained by an optimization procedure using data of the form shown in the graphs of FIGS. 5 and 6, wherein w is tape width, c is cable circumference at tape layer. A typical optimized grading function is shown in FIG. 7.

Some other embodiments of the invention are also possible, e.g., by utilizing two conductive tapes surrounding the dielectric layer, one of the tapes being solid conductor, the other being served conductor. The woven tapes can be unwoven when desired to provide the necessary electrical properties of the cable.

The method of the invention can provide lower attenuation losses than other techniques and hence can allow longer cable sections to be used between repeater amplifiers than in the case of cables made by other known methods. Specifically, it will be noted that looking along any X-axis intercept in FIG. 5 for constant coupling many possible tape widths and pitch angles are possible. However reference to FIG. 6 for the corresponding attenuation of each of these points shows that lower attenuation is achieved at lower pitch angles, and wider tape widths.

Figure 5:
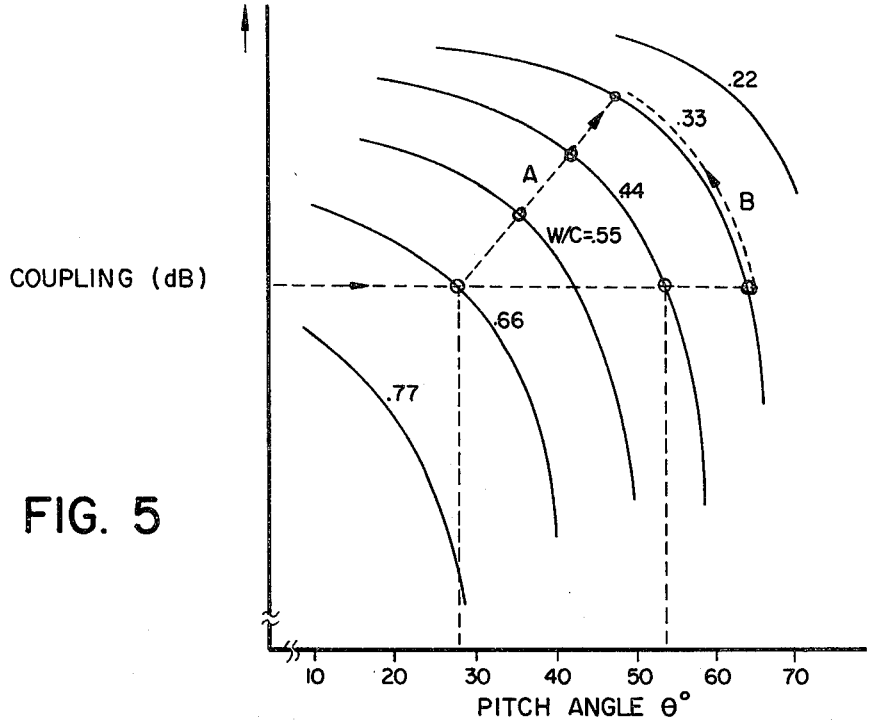
FIG. 5 shows the variation of coupling as a function of outer conductor tape width and pitch angle for a typical cable.

Now in order to grade cables it is necessary to follow a path in FIG. 5 of increasing coupling; the rate that changes take place along the cable length being dependent on the coupling and attenuation changes along the path. Consider two alternative example paths shown on FIG. 5 as path A and path B. Path A allows for width and pitch variation while path B allows only for pitch variation. Both start at the same coupling level. When the corresponding attenuation paths on FIG. 6 are plotted, it is evident that path A provides lower attenuation along its length, or alternatively the changes to the geometry could proceed more slowly between the start and end coupling points than path B and hence provide a longer cable grading.

In general, coupling is a function of the size, shape and density of apertures, all of which change with tape widths and pitch angles. What the FIGS. 5 and 6 plots indicate is that for the same coupling level there is an optimum geometry for best attenuation. It will be understood that there is an installation medium dependency on the attenuation curves—as coupling levels increase, the medium effects on attenuation increase.

The embodiments of the invention in which an exclusive property or privilege is claimed are defined as follows:

1. A method of manufacturing a leaky coaxial cable comprising the steps of:

providing a core having an inner conductor or conductors surrounded by a dielectric layer;

winding at least two conductive tapes therearound, the tape widths and pitch angles being initially selected to provide predetermined coupling and attenuation characteristics;

varying the tape width of at least one of the conductive tapes along the cable length to vary said coupling and attenuation.

2. A method as set out in claim 1, wherein the tapes are wound to provide apertures of predetermined shape and number and having a total area which is a predetermined fraction of the surface area of the cable.

3. A method as set out in claim 1 or 2, wherein two tapes are used and their widths and pitch angle are different.

4. A method as set out in claim 1, wherein the tapes are solid conductors.

5. A method as set out in claim 1, wherein the tapes are braided conductors.

6. A method as set out in claim 1, wherein one of the tapes is solid conductor and another of the tapes is a woven conductor.

7. A method as set out in claim 4, 5 or 6, wherein the widths of the tapes are stepwise tapered.

8. A method as set out in claim 1 or 4 wherein the widths of the tapes are continuously tapered.

9. A method as set out in claim 5 or 6 wherein the wires in at least one of the woven conductors is periodically cut or tied off in the manufacturing process.

10. A method as set out in claim 1, including the further step of varying the pitch angle of at least one of the tapes.

* * * * *